US012263516B2

(12) United States Patent
Uenishi et al.

(10) Patent No.: US 12,263,516 B2
(45) Date of Patent: Apr. 1, 2025

(54) HOT PRESS APPARATUS AND METHOD OF MANUFACTURING HOT-PRESS-FORMED PRODUCT

(71) Applicant: NIPPON STEEL CORPORATION, Tokyo (JP)

(72) Inventors: Kenta Uenishi, Tokyo (JP); Toshiya Suzuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 253 days.

(21) Appl. No.: 17/916,353

(22) PCT Filed: Mar. 30, 2021

(86) PCT No.: PCT/JP2021/013497
§ 371 (c)(1),
(2) Date: Sep. 30, 2022

(87) PCT Pub. No.: WO2021/200923
PCT Pub. Date: Oct. 7, 2021

(65) Prior Publication Data

US 2023/0150004 A1 May 18, 2023

(30) Foreign Application Priority Data

Apr. 3, 2020 (JP) ..... 2020-067815

(51) Int. Cl.
*B21D 22/06* (2006.01)
*B21D 22/20* (2006.01)
(Continued)

(52) U.S. Cl.
CPC ..... *B21D 24/04* (2013.01); *B21D 22/06* (2013.01); *B21D 22/20* (2013.01); *B21D 24/14* (2013.01)

(58) Field of Classification Search
CPC ..... B21D 22/02; B21D 22/06; B21D 22/20; B21D 24/04; B21D 24/14; B21D 53/88
See application file for complete search history.

(56) References Cited

U.S. PATENT DOCUMENTS 8,980,020 B2 3/2015 Sikora et al.
9,127,330 B2 9/2015 Krispinsson
(Continued)

FOREIGN PATENT DOCUMENTS

JP 7-60374 A 3/1995
JP 2003-328031 A 11/2003
(Continued)

*Primary Examiner* — Debra M Sullivan
(74) *Attorney, Agent, or Firm* — Birch, Stewart, Kolasch & Birch, LLP

(57) ABSTRACT

A hot press apparatus includes a first die part 2 and a second die part 3, and a control unit 9. At least one of the first and second die parts 2 and 3 includes a recess 3*a* in the surface facing the other die part in the direction of pressing. A movable die part 4 is provided in the recess 3*a*. The control unit 9 controls the movable die part 4 such that the bottom-dead-center holding period, for which the first and second die parts 2 and 3 are at the bottom-dead center, includes an abutment period for which the movable die part 4 abuts the metal sheet B and a non-abutment period for which the movable die part does not abut the metal sheet B.

17 Claims, 13 Drawing Sheets

(51) Int. Cl.
*B21D 24/04* (2006.01)
*B21D 24/14* (2006.01)

(56) References Cited

U.S. PATENT DOCUMENTS

| | | | | |
|---|---|---|---|---|
| 2012/0073708 | A1 | 3/2012 | Krispinsson | |
| 2012/0186705 | A1 | 7/2012 | Sikora et al. | |
| 2014/0017443 | A1* | 1/2014 | Matsuda ..... | B21D 22/022 72/325 |

FOREIGN PATENT DOCUMENTS

| | | | |
|---|---|---|---|
| JP | 2005-248253 | A | 9/2005 |
| JP | 2012-187605 | A | 10/2012 |
| JP | 2014-18801 | A | 2/2014 |
| JP | 2015-182630 | A | 10/2015 |
| JP | 2015-226936 | A | 12/2015 |
| JP | 5864414 | B2 | 2/2016 |
| JP | 2017-70973 | A | 4/2017 |

* cited by examiner

HOT PRESS APPARATUS AND METHOD OF MANUFACTURING HOT-PRESS-FORMED PRODUCT

TECHNICAL FIELD

The present invention relates to a hot press apparatus and a method of manufacturing a hot-press-formed product.

BACKGROUND ART

In some metallic structural members, properties such as strength may be locally varied. For example, when a high-strength member is used as a vehicle-skeleton member, some low-strength portions may be provided in the member, rather than providing high strength to all the portions. There are several reasons for doing this. For example, machining such as drilling may be performed in low-strength portions. In other applications, the deformation behavior of a member may be controlled by providing low-strength portions that are to be deformed early during deformation of the member.

One method for manufacturing a member with low-strength portions involves welding steels with different properties to provide a tailor-welded blank, followed by hot working (i.e., hot stamping). For example, Japanese Patent No. 5864414 describes a method of hot press forming a steel sheet blank composed of separate sheets that have been welded together. In this method, a steel sheet blank is heated and then hot press formed inside a pair of cooled tools, and, while the blank is still inside the pair of tools, the formed product is hardened. The welded portions of the two sheets are cooled at lower cooling rates with respect to portions on both sides of each welded portion. This forms portions with low martensite contents along the welded portions. The cooling rate is lowered by keeping a gap between the pair of tools and the end product.

JP 2015-226936 A discloses a manufacturing method that enables local adjustment of the construction of a metal structure component. In this manufacturing method, a steel member is hot formed and then at least several sections are hardened through contact with the tool surface. At least one of two sections of the tool surface has a surface coating that decreases or increases thermal conductivity. Sections of the tool surface with different thermal conductivities lead to different cooling rates. The sub-regions of the steel member with different cooling rates have different microscopic structures after hardening.

PRIOR ART DOCUMENTS

Patent Documents

Patent Document 1: Japanese Patent No. 5864414
Patent Document 2: JP 2015-226936 A

SUMMARY OF THE INVENTION

Problems to be Solved by the Invention

The above-described conventional techniques achieve a local decrease in the cooling rate of a metal sheet by virtue of a gap (or clearance) between the formed product and the die, or a thermal-conductivity distribution in the die surface. However, when the formed product has been removed from the die, the temperatures in portions with lower cooling rates are still high. Then, as these portions experience thermal contraction during cooling, the formed product may develop defects of shape. Further, if there are large temperature differences within the formed product when the formed product is removed from the die, the formed product may deform due to thermal contraction, leading to defects of shape. To reduce the temperature of the formed product upon removal from the die as well as temperature differences within the formed product, the formed product must be kept in the die until a uniform temperature is reached inside the formed product. On the other hand, from the viewpoint of manufacture cost, for example, it is preferable to minimize the period of time for which the formed product is held in the die (i.e., bottom-dead-center holding period). That is, it is difficult to achieve both productivity and shape accuracy with conventional methods.

In view of this, the present disclosure provides a hot press apparatus and a method of manufacturing a hot press-formed product that ensure the shape accuracy of a formed product provided with a property distribution without prolonging the bottom-dead-center holding time for the formed product in the die during hot pressing.

Means for Solving the Problems

A hot press apparatus according to an embodiment of the present invention includes: a first die part; a second die part capable of moving relative to the first die part in a direction of pressing; and a control unit adapted to control relative movement of the first die part and the second die part. At least one of the first die part and the second die part includes a recess in a surface facing the other die part in the direction of pressing. A movable die part is provided in the recess, the movable die part movable in a direction crossing the surface facing the other part. The control unit controls the movable die part such that a heated and press formed metal sheet is held between the first die part and the second die part and a bottom-dead-center holding period for which the first die part and the second die part are at a bottom-dead center includes an abutment period for which the movable die part abuts the metal sheet and a non-abutment period for which the movable die part does not abut the metal sheet.

Effects of the Invention

The present disclosure ensures the shape accuracy of a formed product provided with a property distribution without prolonging the bottom-dead-center holding time for the formed product in the die during hot pressing.

Figure 1:
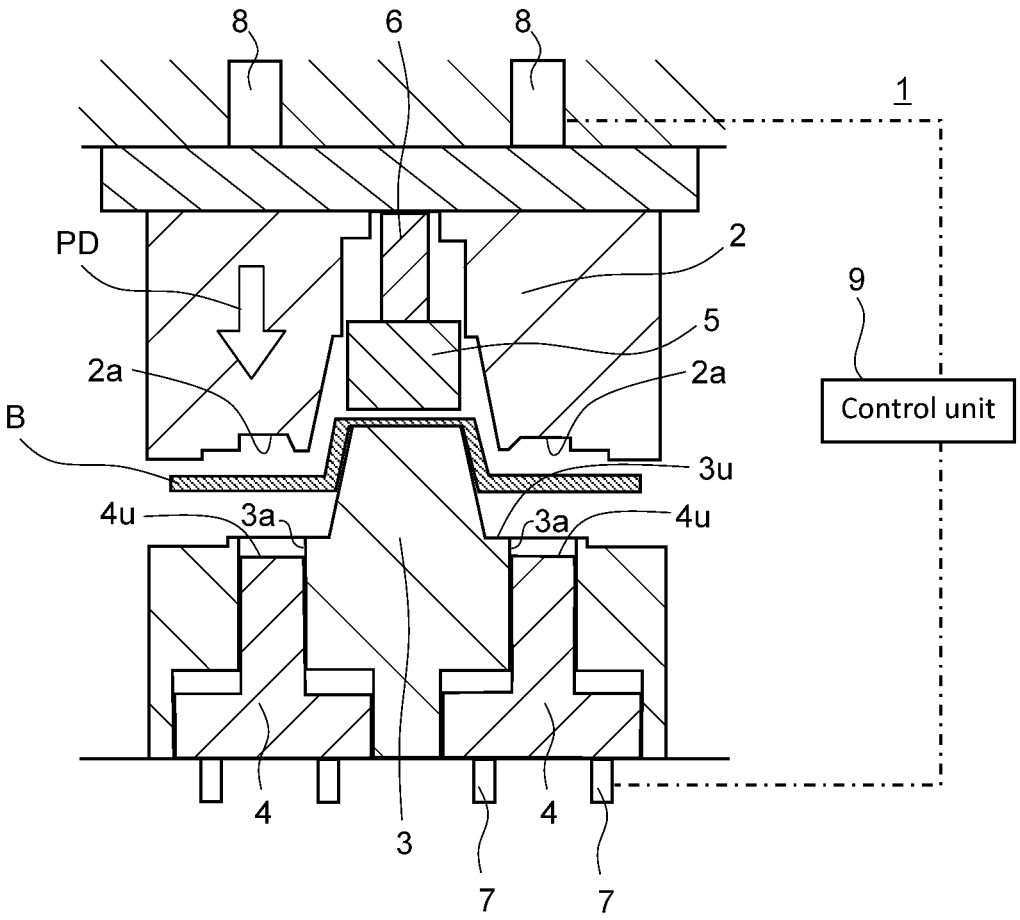
FIG. 1 shows a cross-sectional view of a press apparatus according to an embodiment, illustrating an exemplary construction.

EMBODIMENTS FOR CARRYING OUT THE INVENTION (Arrangement 1)

A hot press apparatus according to an embodiment of the present invention includes: a first die part; a second die part capable of moving relative to the first die part in a direction of pressing; and a control unit adapted to control relative movement of the first die part and the second die part. At least one of the first die part and the second die part includes a recess in a surface facing the other die part in the direction of pressing. A movable die part is provided in the recess, the movable die part movable in a direction crossing the surface facing the other part. The control unit controls a position of the movable die part such that a heated and press formed metal sheet is held between the first die part and the second die part and a bottom-dead-center holding period for which the first die part and the second die part are at a bottom-dead center includes an abutment period for which the movable die part is at an abutting position where it abuts the metal sheet and a non-abutment period for which the movable die part is at a retracted position where it does not abut the metal sheet.

In Arrangement 1 described above, during the bottom-dead-center holding period, cooling rate can be decreased, i.e., gradual cooling can be performed, for the non-abutment period for which the movable die part does not abut the metal sheet. Further, cooling rate can be increased, i.e., rapid cooling can be performed, for the abutment period in the bottom-dead-center holding time for which the movable die part abuts the metal sheet. This will achieve a close-to-uniform temperature distribution of the metal sheet while some of the portions of the formed metal sheet contacted by the movable die part have cooling conditions different from those of the other portions. This provides the formed metal sheet removed from the die with a property distribution derived from the differences in cooling conditions and, at the same time, reduces a decrease in the shape accuracy of the formed product due to temperature differences. This ensures the shape accuracy of a formed product provided with a property distribution without prolonging the bottom-dead-center holding time for the formed product in the die.

In conventional methods in which cooling rate is reduced by a clearance or by means of thermal conductivities of the die surface, the cooling conditions under which part of the member is gradually cooled are predetermined cooling conditions based on the construction of the die. Thus, the metal structure composition obtained by gradual cooling and the temperature distribution of the member as removed from the die also depend on the construction of the die. Changing these features requires adjusting the construction of the die or re-fabricating a die. In contrast, in Arrangement 1 described above, cooling conditions can be controlled by adjusting the length of the abutment period in the bottom-dead-center holding period. Thus, in a pressing process using a hot press apparatus, the cooling conditions under which some portions of the formed metal sheet are gradually cooled can be easily changed.

In Arrangement 1, the movable die part is constructed to be movable between an abutting position and a retracted position. During the bottom-dead-center holding period, the control unit switches the movable die part between a state in which it is at the abutting position and a state in which it is at the retracted position. When the movable die part is at the abutting position, the abutment surface of the movable die part against the metal sheet is at a position equivalent to the forming surface. When the movable die part is at the retracted position, the movable die part is pulled deep into the recess, positioned to be separated from the forming surface. The retracted position is set, for example, to a position at which the metal sheet does not contact the movable die part even when the portion of the metal sheet corresponding to the recess experiences out-of-plane deformation while the die is at the bottom-dead center. A retracted position is decided upon depending on at least one of the surface area of the recess and the sheet thickness of the metal sheet to be processed, for example.

(Arrangement 2)

Starting from Arrangement 1 described above, the control unit may cause the movable die part to abut the metal sheet in an early stage of the bottom-dead-center holding period and then cause the movable die part to be separated from the metal sheet in a late stage of the bottom-dead-center holding period. That is, the control unit may move the movable die part from the abutting position to the retracted position within the bottom-dead-center holding period. This enables forming the metal sheet with the movable die part in a sub-period of the bottom-dead-center holding period in which the metal sheet has a relatively high temperature and is thus easy to form. This makes it easier to ensure local shape accuracy, i.e., the shape accuracy of a portion of the formed metal sheet that corresponds to the movable die part.

(Arrangement 3)

Starting from Arrangement 1 described above, the control unit may cause the movable die part to be separated from the metal sheet in an early stage of the bottom-dead-center holding period and then cause the movable die part to abut the metal sheet in a late stage of the bottom-dead-center holding period. That is, the control unit may move the movable die part from the retracted position to the abutting position within the bottom-dead-center holding period. This makes it possible to cause the movable die part to contact the metal sheet for rapid cooling in a sub-period of the bottom-dead-center holding period in which the temperature of the metal sheet is relatively low. This also makes it easier to achieve a close-to-uniform temperature distribution in the metal sheet. This makes it easier to ensure the shape accuracy of the entire formed metal sheet. Further, it facilitates adjustment of cooling conditions by controlling the abutment period.

Starting from Arrangement 1 described above, the control unit may cause the movable die part to abut the metal sheet in an early stage of the bottom-dead-center holding period and then cause it to be separated and then again cause the movable die part to abut the metal sheet in a late stage of the bottom-dead-center holding period. That is, the control unit may cause the movable die part to move from the abutting position to the retracted position and then again cause it to move to the abutting position within the bottom-dead-center holding period. This makes it possible to rapidly cool the movable die part in a sub-period of the bottom-dead-center holding period with a relatively high temperature and a sub-period with a low temperature. This facilitates control of shape accuracy.

The control unit may control the movable die part such that the abutment period accounts for 10 to 90% of the entire bottom-dead-center holding period, for example. In such implementations, the abutment period is preferably not longer than 80% of the entire bottom-dead-center holding period, more preferably not longer than 70%, and yet more preferably not longer than 50%. In other words, the control unit may control the movable die part such that the non-abutment period is not shorter than 10% of the entire bottom-dead-center holding period. This makes it easier to ensure that the cooling rate of some portions of the metal sheet during the bottom-dead-center holding period is different from that of the other portions and some portions of the formed product have a different metal structure composition from that of the other portions. Thus, the control unit is capable of controlling the lengths of the abutment period and non-abutment period within the bottom-dead-center holding period.

(Arrangement 4)

Starting from any one of Arrangements 1 to 3 described above, the recess may include a first recess provided in the first die part and a second recess provided in the second die part and positioned to face the first recess. In such implementations, the movable die part is located in at least one of the first recess and the second recess that face each other. Thus, a clearance is present on each side of the metal sheet during the non-abutment period for which the movable die part does not abut the metal sheet. This increases the robustness of the cooling conditions.

(Arrangement 5)

Starting from Arrangement 4 described above, the movable die part may be provided in each of the first recess and the second recess facing each other. This further increases the robustness of the cooling conditions.

(Arrangement 6)

Starting from any one of Arrangements 1 to 5 described above, a surface of the movable die part to be in contact with the metal sheet when the movable die part abuts the metal sheet while the die parts are at the bottom-dead center may be positioned to be flush with a die surface surrounding the recess provided with the movable die part. This provides flat portions of the formed metal sheet with a property distribution.

(Arrangement 7)

Starting from any one of Arrangements 1 to 6 described above, a top surface of the movable die part may include a protrusion adapted to abut the metal sheet and a recess adapted not to abut the metal sheet when the movable die part abuts the metal sheet while the die parts are at the bottom-dead center. A clearance is created by the recess in the movable die part even during the abutment period for which the movable die part is in contact with the metal sheet. This enables gradual cooling. Further, cooling conditions can be changed by changing the shapes of the protrusion and recess on the top surface of the movable die part. As used herein, top surface of the movable die part is the surface of that one of the ends, as determined along the direction of movement, of the movable die part in the recess which is closer to the position at which the metal sheet is to be located.

(Arrangement 8)

Starting from any one of Arrangements 1 to 7 described above, a top surface of one movable die part in one of the first die part and the second die part may include a recess or protrusion recessed or protruding in the direction of pressing. A surface of the other die part or movable die part facing the one movable die part in the direction of pressing may have a shape corresponding to the recess or protrusion on the top surface of the one movable die part. When the one movable die part abuts the metal sheet while the die parts are at the bottom-dead center, the surface of the other die part or movable die part facing the one movable die part may be constructed to abut the metal sheet. Thus, the metal sheet can be formed to a shape corresponding to the recessed/protruding shape of the movable die part.

(Arrangement 9)

Starting from any one of Arrangements 1 to 8 described above, the control unit may adjust a distance between the metal sheet and the movable die part found when the movable die part is at the retracted position. This makes it possible to set an appropriate retracted position that makes it less likely that the metal sheet at the retracted position and the movable die part contact each other. When the die is at the bottom-dead center, a portion of the metal sheet corresponding to the recess may experience out-of-plane deformation. The degree of such out-of-plane deformation varies depending on the surface area of the recess and the thickness of the metal sheet. In view of this, the control unit may, for example, adjust the retracted position of the movable die part depending on the thickness of the metal sheet to make it less likely that, when the die is at the bottom-dead center, the metal sheet with out-of-plane deformation and the movable die part at the retracted position contact each other.

Starting from any one of Arrangements 1 to 9, the hot press apparatus may include a cooling mechanism adapted to cool the first die part and the second die part. For example, at least one of the first and second die parts may include a tube or groove for allowing a cooling medium to pass through.

(Manufacturing Method 1)

A method of manufacturing a hot press-formed product according to an embodiment of the present invention includes: positioning a heated metal sheet between a first die part and a second die part; press forming the metal sheet by moving the first die part and the second die part closer to each other in a direction of pressing; holding the metal sheet while the first die part and the second die part are at a bottom-dead center; and moving, to the metal sheet, a movable die part provided in a recess in at least one of the first die part and the second die part during a bottom-dead-center holding period for which the metal sheet is held at the bottom-dead center. The bottom-dead-center holding period includes an abutment period for which the movable die part is at an abutting position where it abuts the metal sheet and a non-abutment period for which the movable die part is at a retracted position where it does not abut the metal sheet.

In Manufacturing Method 1 described above, cooling rate can be reduced during the non-abutment period in the bottom-dead-center holding period. Further, cooling rate can be increased during the abutment period in the bottom-dead-center holding period. This will achieve a close-to-uniform temperature distribution of the metal sheet while the portions of the formed metal sheet contacted by the movable die part have different cooling conditions from those of the other portions. This ensures the shape accuracy of a formed product provided with a property distribution without prolonging the bottom-dead-center holding time for the formed product in the die.

(Manufacturing Method 2)

Starting from Manufacturing Method 1 described above, the movable die part may abut the metal sheet in an early stage of the bottom-dead-center holding period and then the movable die part may be separated from the metal sheet in a late stage of the bottom-dead-center holding period. That is, the movable die part may be controlled to move from the abutting position to the retracted position during the bottom-dead-center holding period.

(Manufacturing Method 3)

Starting from Manufacturing Method 1 described above, the movable die part may be separated from the metal sheet in an early stage of the bottom-dead-center holding period and then the movable die part may abut the metal sheet in a late stage of the bottom-dead-center holding period. That is, the movable die part may be controlled to move from the retracted position to the abutting position during the bottom-dead-center holding period.

(Manufacturing Method 4)

Starting from any one of Manufacturing Methods 1 to 3 described above, a surface of the movable die part to be in contact with the metal sheet when the movable die part abuts the metal sheet while the die parts are at the bottom-dead center may be positioned to be flush with a die surface to be in contact with the metal sheet surrounding the recess provided with the movable die part.

(Manufacturing Method 5)

Starting from any one of Manufacturing Methods 1 to 4 described above, a top surface of the movable die part may include a protrusion adapted to abut the metal sheet and a recess adapted not to abut the metal sheet when the movable die part abuts the metal sheet while the die parts are at the bottom-dead center.

(Manufacturing Method 6)

Starting from any one of Manufacturing Methods 1 to 5 described above, a top surface of one movable die part in one of the first die part and the second die part may include a recess or protrusion recessed or protruding in the direction of pressing. A surface of the other die part or movable die part facing the one movable die part in the direction of pressing may have a shape corresponding to the recess or protrusion on the top surface of the one movable die part. When the one movable die part abuts the metal sheet while the die parts are at the bottom-dead center, the surface of the other die part or movable die part facing the one movable die part may abut the metal sheet.

Starting from any one of Manufacturing Methods 1 to 6 described above, the movable die part may be controlled such that the non-abutment period is not shorter than 10% of the entire bottom-dead-center holding period. It should be noted that a method of manufacturing a hot press-formed product using the hot press apparatus of any one of Arrangements 1 to 9 described above by any one of Manufacturing Methods 1 to 6 described above is included in the embodiments of the present invention.

Now, embodiments of the present invention will be described in detail with reference to the drawings. The same or corresponding elements in the drawings are labeled with the same reference characters and their description will not be repeated. For ease of explanation, the drawings to which reference will be made below show components in a simplified or schematic manner, or omit some components.

(Exemplary Construction of Press Apparatus)

Figure 2:
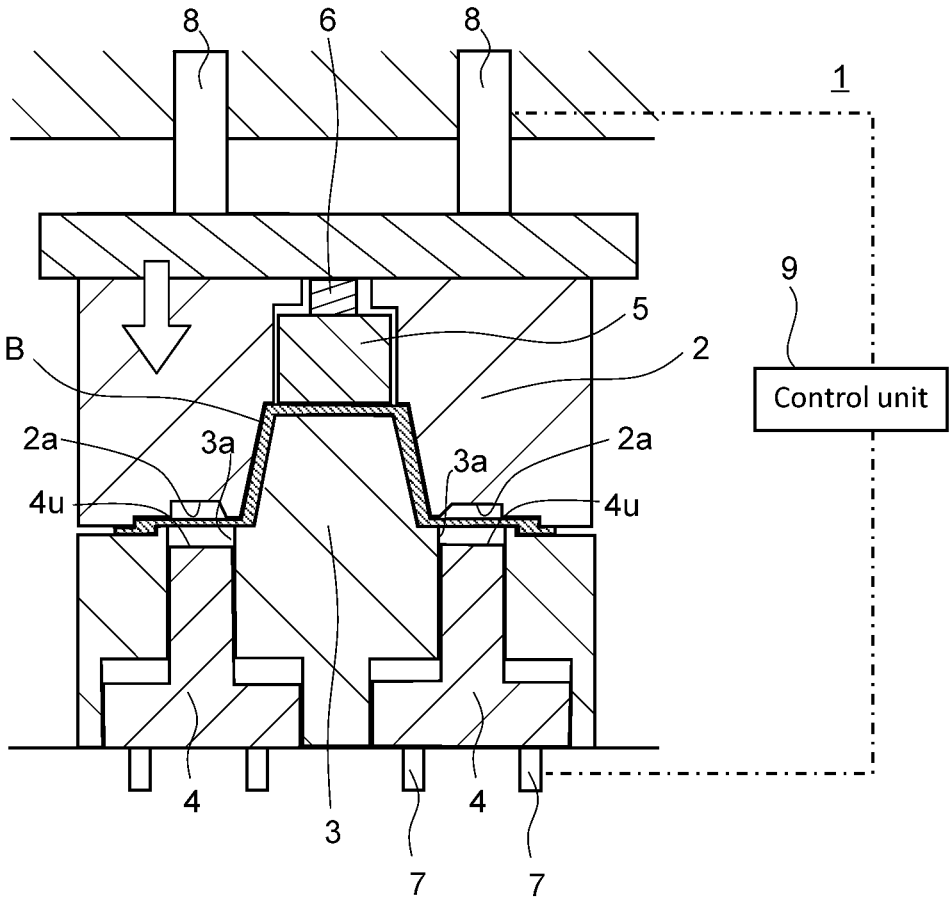
FIG. 2 shows the press apparatus shown in FIG. 1 as being at its bottom-dead center.

FIG. 1 is a cross-sectional view of a hot press apparatus according to an embodiment, illustrating an exemplary construction. FIG. 2 shows the die of the press apparatus shown in FIG. 1 as being at its bottom-dead center. The hot press apparatus 1 press forms a metal sheet B to a press-formed product. The hot press apparatus 1 includes, as its die parts, a die block 2, a punch 3, a die pad 5, a movable die part 4, and a control unit 9. The die block 2 is movable in the direction of pressing PD relative to the punch 3. That is, the die block 2 and punch 3 are movable relative to each other. The directions of such relative movements are referred to as direction of pressing.

The die block 2 is movable by a lift mechanism (i.e., actuator) 8 in the direction of pressing relative to the punch 3. The lift mechanism 8 may include, for example, a hydraulic cylinder, air cylinder, air cushion or cam. In the present implementation, the die block 2 moves relative to the punch 3; in some arrangements, the punch 3 may move relative to the die block 2. In other arrangements, both the die block 2 and punch 3 may be constructed to move.

In the hot press apparatus 1, the metal sheet B is positioned between the die block 2 and punch 3 and the metal sheet B is pushed by both the die block 2 and punch 3 to press form the metal sheet B. The die block 2 and punch 3 exemplify the first and second die parts.

The die block 2 has a shape recessed inwardly and corresponding to the shape of the product to be press formed. The punch 3 has a protruding shape corresponding to the recessed shape of the die block 2. The surface of the die block 2 that faces the punch 3 includes a pressing surface that contacts the metal sheet B to press it. The surface of the die block 2 that faces the punch 3 has recesses 2*a*. The recesses 2*a* do not abut the metal sheet B even when the die is at the bottom-dead center. That is, each recess 2*a* forms a clearance between it and the metal sheet B when the die is at the bottom-dead center (see FIG. 2).

The die pad 5 is movable by a lift mechanism 6, such as a hydraulic cylinder, in the direction of pressing relative to the die block 2. The die pad 5 is movable in the top-bottom direction together with the punch 3 with the top surface of the die pad being pressed against the metal sheet B. The die pad 5 is located to face the top surface of the punch 3. The top surface of the die pad 5 and the top surface of the punch 3 face each other in the direction of pressing. In some implementations, the die pad 5 may be omitted.

The surface of the punch 3 facing the die block 2 includes a pressing surface that contacts the metal sheet B to press it. The surface of the punch 3 facing the die block 2 includes recesses 3*a*. A movable die part 4 is provided in each recess 3*a*. The recess 3*a* of the punch 3 is located to face the respective recess 2*a* of the die block 2 in the direction of pressing. That is, when viewed in the direction of pressing, at least part of the recess 3*a* of the punch 3 overlaps the recess 2*a* of the die block 2.

The movable die part 4 is provided in the recess 3*a* of the punch 3 and movable relative to the punch 3 in a direction crossing the surface of the punch 3 facing the die block 2. The movable die part 4 is movable by a lift mechanism (i.e., actuator) 7 in the depth direction of the recess 3*a*. In the implementation shown in FIG. 1, the movable die part 4 may be in a state in which it is pushed into the recess 3*a* of the punch 3. That is, the top surface of the movable die part 4 can enter deep into the recess 3*a* away from the edge of the opening of the recess 3*a*. In the implementation shown in FIG. 2, with the die being at the bottom-dead center, the top surface 4*u* of the movable die part 4 has been pulled deep into the recess 3*a*. In this case, the movable die part 4 does not abut the metal sheet B between the die block 2 and punch 3. Thus, the movable die part 4 is constructed to be movable between a position where it abuts the metal sheet B held by the die at the bottom-dead center, i.e., abutting position, and a position where a clearance is present between it and the metal sheet B, i.e., retracted position. In the implementation shown in FIG. 2, the movable die part 4 is movable in the direction of pressing; however, the movement of the movable die part 4 is not limited to the direction of pressing. The lift mechanism 7 may be, for example, a hydraulic cylinder, air cylinder, cam, or gas cushion.

Figure 3:
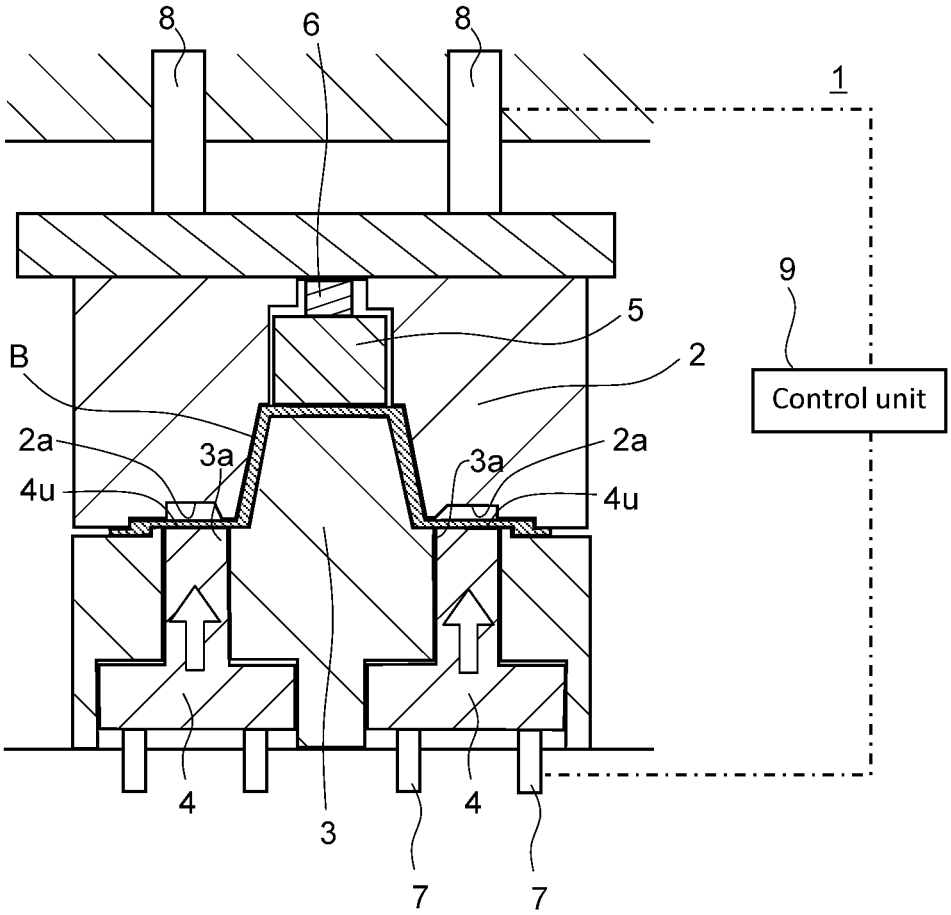
FIG. 3 illustrates how the movable die part 4 abuts the metal sheet B while the die is at its bottom-dead center.

FIG. 3 illustrates how the movable die part 4 abuts the metal sheet B while the die is at its bottom-dead center. In this manner, the movable die part 4 is also movable from a state in which it sits deep in the recess 3*a* to a state where at least the top surface 4*u* of the movable die part 4 is located as high as the pressing surface 3*u* surrounding the recess 3*a*. In the present implementation, the top surface 4*u* of the movable die part 4 is shaped such that it can be flush with the pressing surface 3*u* surrounding the recess 3*a*. The entire top surface 4*u* of the movable die part 4 abuts the metal sheet B.

The control unit 9 controls the die block 2, punch 3 and movable die part 4. In the implementation shown in FIGS. 1 to 3, the control unit 9 controls the lift mechanism 8 for the die block 2 to control relative movement of the die block 2 and punch 3. The control unit 9 controls the lift mechanism 7 to control movement of the movable die parts 4. The control unit 9 supplies the lift mechanisms (i.e., actuators) 8 and 7 with control signals to control driving of these mechanisms.

Beginning with the state in which the heated metal sheet B is positioned between the die block 2 and punch 3 as separated from each other, the control unit 9 moves the die block 2 and punch 3 closer to each other in the direction of pressing until they reach the bottom-dead center. The metal sheet B is thus press formed. Thereafter, the control unit 9 holds the die block 2 and punch 3 at the bottom-dead center. Thus, during the bottom-dead-center holding period, the portions of the formed metal sheet B that are in contact with the die block 2 and punch 3 are rapidly cooled and hardened.

The control unit 9 controls each movable die part 4 in such a manner that the bottom-dead-center holding period includes an abutment period for which the movable die part 4 abuts the metal sheet B and a non-abutment period for which the movable die part 4 does not abut the metal sheet B. That is, the control unit 9 controls operation of the movable die part so as to hold the movable die part 4 at a position where it abuts the metal sheet B for an abutment period that is shorter than the bottom-dead-center holding period. The control unit 9 switches the movable die part 4 from the abutting position to the retracted position, or from the retracted position to the abutting position, during the bottom-dead-center holding period.

In the non-abutment period of the bottom-dead-center holding period, for example, the control unit 9 causes each movable die part 4 to stay deep in its recess 3*a*, as shown in FIG. 2. That is, the top surface 4*u* of the movable die part 4 is controlled to be deep within the recess 3*a* away from the edge of its opening, that is, at the retracted position where the top surface 4*u* is not in contact with the metal sheet B. This creates a clearance between the movable die part 4 and metal sheet B. It will be understood that the control unit 9 may control the amount of clearance. For example, the control unit 9 may control the associated lift mechanism 7 to adjust the retracted position of the top surface 4*u* of the movable die part 4.

In the abutment period in the bottom-dead-center holding period, for example, the control unit 9 moves the movable die part 4 so it reaches at least the opening of the recess 3*a*, as shown in FIG. 3. That is, the top surface 4*u* of the movable die part 4 is controlled to be at the opening of the recess 3*a*, that is, such that the top surface 4*u* is in contact with the metal sheet B, i.e., at the abutting position. Thus, the movable die part 4 abuts the metal sheet B.

During the bottom-dead-center holding period, the control unit 9 causes at least one of two operations to occur, namely, causing the movable die part 4 as abutting the metal sheet B to be separated therefrom, or causing the movable die part 4 as separated from the metal sheet B to abut it. Further, the control unit 9 controls the movable die part 4 such that the abutment period and non-abutment period of the bottom-dead-center holding period have predetermined lengths. Data specifying an abutment period or non-abutment period in the bottom-dead-center holding period may be stored on a storage device accessible for the control unit 9, for example. By way of example, the storage device may store data specifying at least one of a period of time (i.e., timing) where the movable die part 4 is to abut the metal sheet B and a period of time where the movable die part 4 is separated from the metal sheet B, with respect to the point of time at which the die begins to be at the bottom-dead center. The control unit 9 uses the stored data to control the abutment period and non-abutment period of the bottom-dead-center holding period.

The control unit 9 may be constituted by, for example, a computer including a processor and a storage device (i.e., memory). The processor executes a program stored on the storage device to implement the function of supplying control information to the lift mechanisms 7 and 8 for the die block 2 and punch 3 (i.e., first and second die parts) as well as the movable die parts 4. By way of example, based on input from the outside and/or data stored in advance on the memory, the control unit 9 decides on times where the die block 2, punch 3 and movable die parts 4 are to be moved as well as amounts of movement (or directions of movement), and determines the control information necessary for these movements. The control unit 9 outputs the control information to the lift mechanism 7.

(Exemplary Manufacturing Process)

Now, an exemplary process of manufacturing a hot press-formed product using the hot press apparatus 1 will be described. First, a material, i.e., a metal sheet B, is heated. The metal sheet B may be, for example, a flat sheet, or may be an intermediate formed product that has been press formed. By way of example, the metal sheet B is a steel sheet. At the heating step, the metal sheet B is heated to the Ac3 point or above to austenitize the metallic microstructure. The heated metal sheet B is transported and positioned between the die block 2 and punch 3 of the hot press apparatus 1.

In the hot press apparatus 1, the heated metal sheet B is positioned between the die block 2 and punch 3, and at least one of the die block 2 and punch 3 is moved to the bottom-dead center. Thus, the metal sheet B is hot press formed. The formed metal sheet B is held between the die block 2 and punch 3 at the bottom-dead center. During this bottom-dead-center holding period, the metal sheet B in contact with the die block 2 and punch 3 is rapidly cooled. Some portions of the die parts of the hot press apparatus 1 provide clearance portions constituted by recesses 2*a* in the die block 2 and recesses 3*a* in the punch 3. Each recess 3*a* is provided with a movable die part 4. When the die is at the bottom-dead center, the recesses 2*a* are not in contact with the metal sheet B. Each movable die part 4, when pulled deep into the recess 3*a* i.e. at the retracted position, is not in contact with the metal sheet B. Thus, portions of the metal sheet B that correspond to the clearance portions constituted by the recesses 2*a* and 3*a* experience lower cooling rates than the portions that are in contact with the die block 2 and punch 3. This achieves gradual cooling of some portions of the metal sheet B.

Halfway through the bottom-dead-center holding period, the control unit 9 operates the movable die parts 4 so as to abut the metal sheet B. This switches cooling rate from gradual cooling to rapid cooling. Alternatively, the control unit 9 ensures that the movable die parts 4 already abut the metal sheet B at the beginning of the bottom-dead-center holding period, and then, halfway through the bottom-dead-center holding period, operates the movable die parts 4 to cause the movable die parts 4 to be separated from the metal sheet B. This switches cooling rate from rapid cooling to gradual cooling. This achieves a close-to-uniform temperature distribution of the metal sheet B at the end of the bottom-dead-center holding period while gradually cooling some portions of the formed metal sheet B to change cooling conditions. Further, controlling the operation of the movable die parts 4 while the die is in the bottom-dead-center holding period enables controlling cooling conditions of the gradually cooled portions.

Upon completion of the bottom-dead-center holding period, the formed metal sheet B (i.e., formed product) is removed from the die parts (i.e., die block 2 and punch 3). The formed product thus obtained has been provided with a strength distribution, and has good shape accuracy.

Details of the mechanism with which a strength distribution is provided are as follows: there are three types of cooling of portions of the metal sheet B being hot press formed that correspond to the clearance portions i.e. recesses 2*a* and 3*a*, namely: (1) heat conduction within the metal sheet B; (2) heat conduction from the metal sheet B to the atmosphere; and (3) radiation from the metal sheet B to the die. As such, the cooling rates at the clearance portions are lower than those from heat conduction from the metal sheet B to the die due to the sheet's contact with the die. If the cooling rate from austenite is lower than the critical cooling rate which depends on the steel sheet serving as a material, diffusion transformation occurs within the steel, producing a soft metallic microstructure of ferrite and/or bainite, for example. On the other hand, the portions in contact with the die experience non-diffusion transformation, providing a hard metallic microstructure mainly composed of martensite. That is, reducing cooling rate for some portions of the metal sheet enables manufacturing of a press-formed product with some softened portions.

If there are large temperature differences within the formed metal sheet (i.e., formed product) when the formed product is removed from the die, thermal contraction may cause the formed product to deform, leading to defects of shape. In contrast, according to the present embodiment, the bottom-dead-center holding period includes an abutment period for which the movable die part 4 abuts the metal sheet B and a non-abutment period for which a clearance is present between the movable die part 4 and metal sheet B. This results in a close-to-uniform temperature, rather than temperature differences, in the formed product upon completion of the bottom-dead-center holding period. This makes it easier to ensure the shape accuracy of the entire formed product. Further, during the abutment period in the bottom-dead-center holding period, the metal sheet is cooled while being gripped by the movable die parts 4. This makes it easier to ensure shape accuracy, due to the portions gripped by the movable die parts 4 than in arrangements where the metal sheet is not gripped throughout the bottom-dead-center holding period.

The movable die parts 4 are caused to abut the metal sheet B in an early stage of the bottom-dead-center holding period and, thereafter, the movable die parts 4 are caused to be separated from the metal sheet B in a late stage of the bottom-dead-center holding period. That is, during the bottom-dead-center holding period, there is an operation of causing the movable die parts 4 as abutting the metal sheet B to be separated therefrom.

Figure 4:
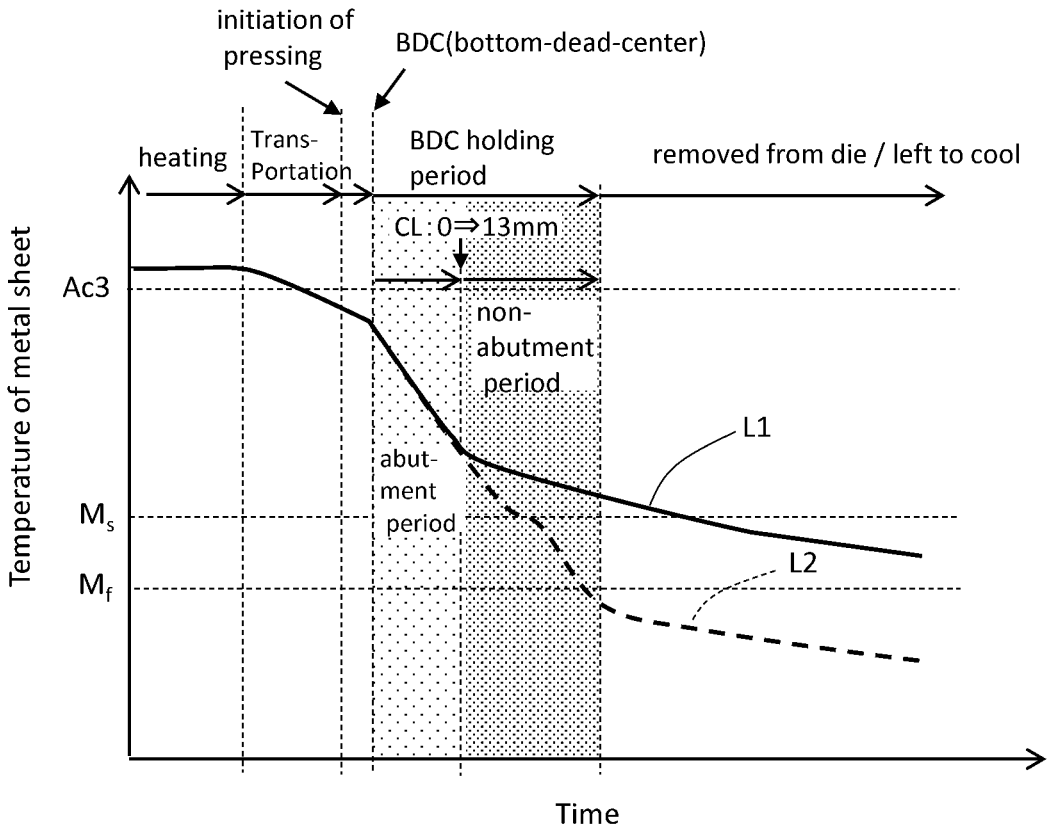
FIG. 4 is a graph illustrating an implementation where an abutment period is provided in an early stage of the bottom-dead-center holding period.

FIG. 4 is a graph illustrating an implementation where an abutment period is provided in an early stage of the bottom-dead-center holding period. In FIG. 4, line L1 indicates the temperature of the portions of the metal sheet B being press formed that correspond to the movable die parts 4. Line L2 indicates the temperature of the portions of the metal sheet B that abut the die throughout the bottom-dead-center holding period (i.e., other portions). In the implementation shown in FIG. 4, at the beginning of the bottom-dead-center holding period, the movable die parts 4 abut the metal sheet B. That is, at this time, the clearance CL between the movable die parts 4 and metal sheet B is 0 mm. Thereafter, the movable die parts 4 are separated from the metal sheet B, and still remain separated at the end of the bottom-dead-center holding period. At its time, the clearance is, by way of example, 13 mm. That is, in the implementation of FIG. 4, when the die starts to be at the bottom-dead center, there is an abutment period for which the movable die parts 4 abut the metal sheet B in an early stage, and the period of time after the abutment period until the die ceases to be at the bottom-dead center constitutes the non-abutment period. During the abutment period, the portions of the metal sheet B corresponding to the movable die parts 4 are gripped by the movable die parts 4 such that their shape is maintained, and at the same time rapidly cooled as is the case with the other portions, as indicated by line L1. Thus, the difference between the temperature of the portions of the metal sheet B corresponding to the movable die parts 4 and the temperature of the other portions does not widen. During the non-abutment period, the portions of the metal sheet B corresponding to the movable die parts 4 experience a cooling rate lower than during the abutment period, and are gradually cooled.

Thus, the bottom-dead-center holding period includes a period where some portions of the metal sheet are rapidly cooled and a period where they are gradually cooled, which reduces the difference between the temperature of the gradually cooled portions and that of the other portions. This makes it easier to ensure the shape accuracy of the entire formed product. Further, the gradually cooled portions are gripped by the die for part of the bottom-dead-center holding period, which makes it easier to ensure the shape accuracy of the gradually cooled portions.

In the implementation shown in FIG. 4, the portions of the metal sheet B corresponding to the movable die parts 4, rapidly cooled during the abutment period, are separated from the movable die parts 4 before the portions reach the Ms point (martensitic transformation starting point), and gradual cooling begins. This produces a soft metallic microstructure. On the other hand, as indicated by line L2, the other portions of the metal sheet B other than the portions corresponding to the movable die parts 4 continue to abut the die part and are rapidly cooled throughout the bottom-dead-center holding period. The other portions are cooled to the Mf point (martensitic transformation finishing point) and lower during the bottom-dead-center holding period. This produces a hard metallic microstructure mainly composed of martensite. Thus, the portions of the formed metal sheet B corresponding to the movable die parts 4 and the other portions have different properties (i.e., strengths in the present implementation).

In the implementation of FIG. 4, in an early stage of the bottom-dead-center holding period where the temperature is relatively high, the portions of interest of the metal sheet B are in the abutment period and are thus rapidly cooled. Since the metal sheet B is gripped by the movable die part 4 for a period where the metal sheet has a high temperature and is soft, this makes it easier to ensure shape accuracy, due to the gripped portions.

During the bottom-dead-center holding period, the movable die part 4 are caused to abut the metal sheet B in an early stage and, then, the movable die parts 4 are separated from the metal sheet B in a late stage of the bottom-dead-center holding period. That is, during the bottom-dead-center holding period, there is an operation of causing the movable die parts 4 as abutting the metal sheet B to be separated therefrom.

Figure 5:
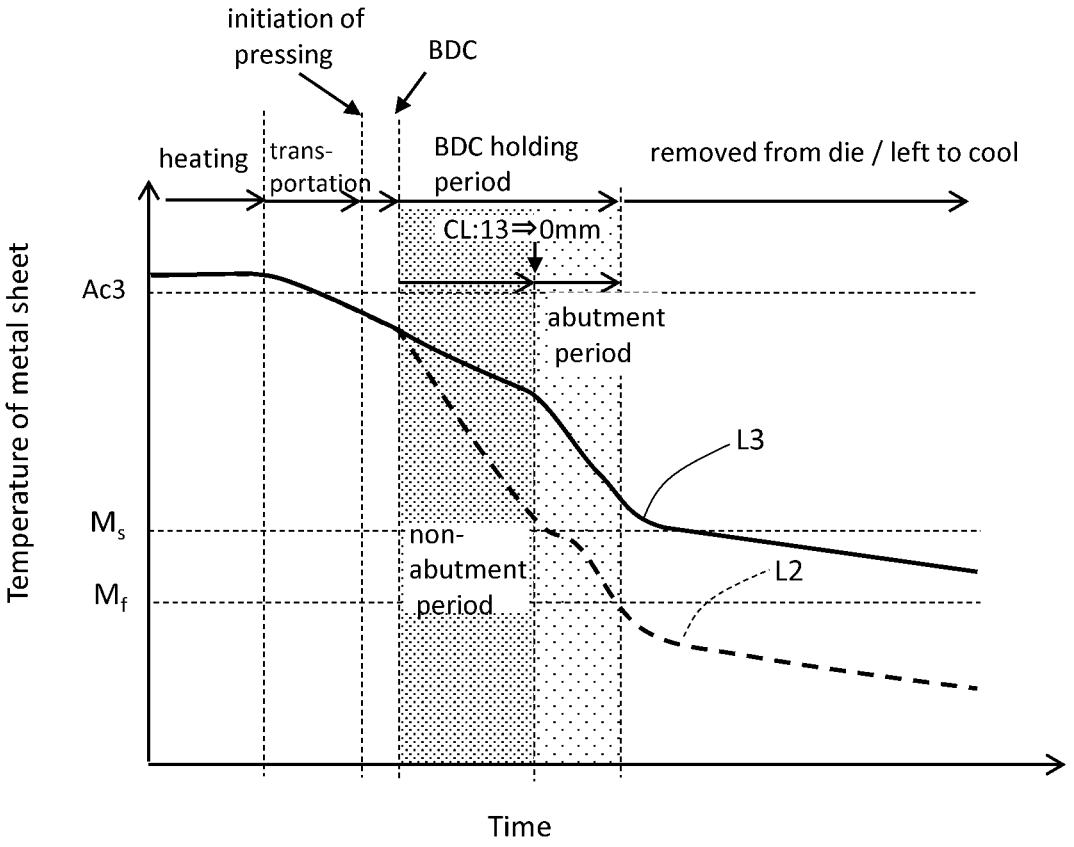
FIG. 5 is a graph illustrating an implementation where an abutment period is provided in a late stage of the bottom-dead-center holding period.

FIG. 5 is a graph illustrating an implementation where an abutment period is provided in a late stage of the bottom-dead-center holding period. In FIG. 5, line L3 indicates the temperature of the portions of the metal sheet B being press formed that correspond to the movable die parts 4. Line L2 indicates the temperature of the portions of the metal sheet B that abut the die throughout the bottom-dead-center holding period (i.e., other portions). In the implementation shown in FIG. 5, at the beginning of the bottom-dead-center holding period, the movable die parts 4 are separated from the metal sheet B. At this time, the clearance CL is, by way of example, 13 mm. Thereafter, the movable die parts 4 abut the metal sheet B such that the clearance is 0 mm, and still abut it at the end of the bottom-dead-center holding period. That is, in the implementation of FIG. 5, when the die starts to be at the bottom-dead center, there is a non-abutment period in an early stage, and the period of time after the non-abutment period until the die ceases to be at the bottom-dead center constitutes the abutment period. Since the bottom-dead-center holding period includes a non-abutment period and an abutment period, it is easier to ensure the shape accuracy of the formed product.

In the implementation shown in FIG. 5, the abutment period for the portions of the metal sheet B corresponding to the movable die parts 4 ends before the temperature drops down to the Ms point, as indicated by line L3. This produces a soft metallic microstructure. On the other hand, as indicated by line L2, the other portions of the metal sheet B other than the portions corresponding to the movable die parts 4 are rapidly cooled during the bottom-dead-center holding period, and cooled to the Mf point and below. This produces a hard metallic microstructure mainly composed of martensite. Thus, the portions of the formed metal sheet B corresponding to the movable die parts 4 and the other portions have different properties (e.g., strengths).

In the implementation of FIG. 5, in a late stage of the bottom-dead-center holding period where the temperature is relatively low and cooling rate has become low, the portions of interest of the metal sheet B are in the abutment period and are thus rapidly cooled. In this implementation, the temperature differences caused by rapid cooling are small, which facilitates temperature control. Further, the metal sheet B is gripped and rapidly cooled when the temperature has become low and the metal sheet has become somewhat hard, which make it easier to ensure shape accuracy.

Early stage of the bottom-dead-center holding period means a period including at least part of the first half of the bottom-dead-center holding period, and may include, or may not include, the beginning of the bottom-dead-center holding period. Late stage of the bottom-dead-center holding period means a period including at least part of the second half of the bottom-dead-center holding period, and may include, or may not include, the end of the bottom-dead-center holding period.

The abutment period and non-abutment period of the bottom-dead-center holding period are not limited to these exemplary implementations. For example, there may be two or more separate abutment periods in the bottom-dead-center holding period. By way of example, an abutment period may be provided in each of an early stage and a late stage of the bottom-dead-center holding period, and a non-abutment period may be provided in an intermediate period between the early and late stages.

Although not limiting, the bottom-dead-center holding period may be 2 to 90 seconds, for example. The longer the bottom-dead-center holding period, the better from the viewpoint of the uniformity of the temperature distribution of the formed product upon completion of the bottom-dead-center holding period; on the other hand, the shorter the bottom-dead-center holding period, the better from the viewpoint of manufacture efficiency. In view of this, a lower limit for the bottom-dead-center holding period is preferably 10 seconds, and more preferably 15 seconds. An upper limit for the bottom-dead-center holding period is preferably 90 seconds, and more preferably 30 seconds. In the present embodiment, the bottom-dead-center holding period includes an abutment period and a non-abutment period; as such, a uniform temperature distribution in the formed product after completion of the bottom-dead-center holding can easily be achieved even when the bottom-dead-center holding period is not longer than 30 seconds, for example.

The clearance CL of the non-abutment period, that is, the distance between the movable die parts 4 at the retracted position and the metal sheet B is not limited to the above-mentioned example of 13 mm. The distance between the movable die parts 4 at the retracted position and the metal sheet B may be, for example, not smaller than 2 mm, preferably not smaller than 4 mm, and more preferably not smaller than 6 mm. A distance between the movable die parts 4 at the retracted position and the metal sheet B may decided upon depending on the surface area of a recess 3*a* as viewed in the direction of pressing and the thickness of the metal sheet B. For example, if the surface area of a recess 3*a* is 1800 $mm^2$ (60 by 30 mm) and the thickness of the metal sheet is 2.6 mm, then, the distance between the movable die parts at the retracted position and the metal sheet is preferably not smaller than 2 mm. This makes it less likely that the metal sheet contacts a movable die part at the retracted position even when the metal sheet experiences out-of-plane deformation. The control unit 9 may adjust the clearance CL by adjusting the retracted position of the movable die parts 4. By way of example, the control unit 9 may decide on a retracted position for the movable die parts 4 in response to input by an operator. The control unit 9 may decide on a retracted position for the movable die parts 4 depending on the clearance CL, the thickness of the metal sheet B or other values that have been input.

The position of the movable die parts 4 for the period between the initiation of pressing and the point of time at which the die reaches the bottom-dead center is not limited to any particular one, and they may be at the abutting position or may be at the retracted position. For example, if an abutment period is provided in an early stage of the bottom-dead-center holding period as shown in FIG. 4, the movable die parts 4 may be at the abutting position from the initiation of pressing, even before the die reaches the bottom-dead center. This eliminates the necessity to move the movable die part 4 at the beginning of the bottom-dead-center holding period. For the same reason, if a non-abutment period is provided in an early stage of the bottom-dead-center holding period as shown in FIG. 5, the movable die parts 4 may be at the retracted position from the initiation of pressing i.e. before the die reaches the bottom-dead center.

(Variations of Movable Die Parts)

Figure 6:
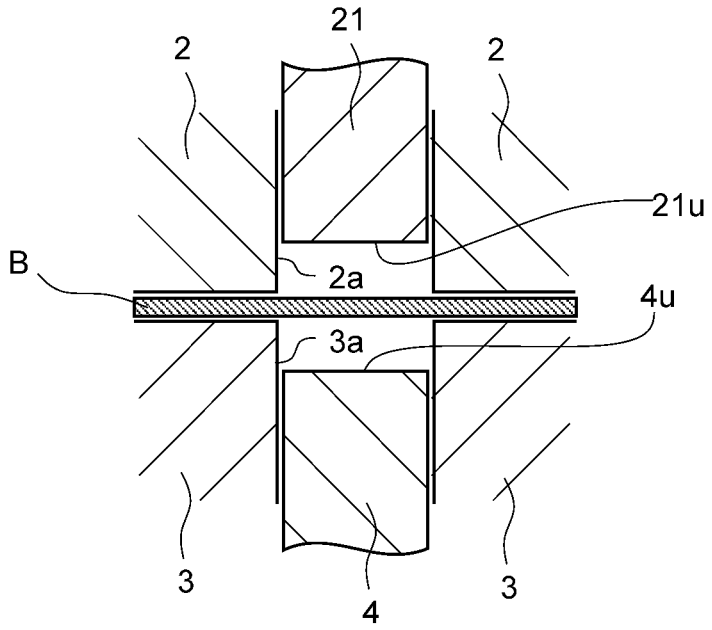
FIG. 6 shows a variation of the clearance portion, modified in construction.

FIG. 6 shows a variation of the clearance portion, modified in construction. In the implementation shown in FIG. 6, a recess 2*a* in the die block 2 is provided, positioned to face a recess 3*a* in the punch 3. A movable die part 4 is provided in the recess 3*a* of the punch 3, and a movable die part 21 is provided in the recess 2*a* of the die block 2. The movable die parts 4 and 21 are positioned to face each other. That is, as viewed in the direction of movement of the movable die part 4 in the recess 3*a*, at least part of the top surface 4*u* of the movable die part 4 is positioned to overlap at least part of the top surface 21*u* of the movable die part 21.

In the implementation shown in FIG. 6, during the abutment period of the bottom-dead-center holding period, the top surface 4*u* of the movable die part 4 abuts one side of the metal sheet B, while the top surface 21*u* of the movable die part 21 abuts the other side (i.e., opposite side) of the metal sheet B. Thus, during the abutment period, both sides of the metal sheet B can be cooled and both sides can be gripped by movable die parts. This makes it easier to ensure cooling rate and shape accuracy.

Figure 7:
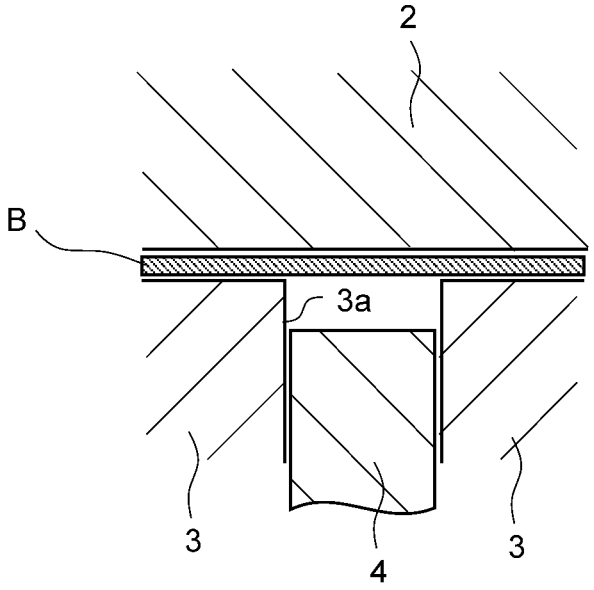
FIG. 7 shows another variation of the clearance portion, modified in construction.

FIG. 7 shows another variation of the clearance portion, modified in construction. In the implementation shown in FIG. 7, no recess is provided in the die block 2 at a position facing a recess 3*a* in the punch 3. A movable die part 4 is provided in the recess 3*a* of the punch 3. During the abutment period of the bottom-dead-center holding period, the top surface 4*u* of the movable die part 4 abuts one side of the metal sheet B, while the die block 2 abuts the other side (i.e., opposite side) of the metal sheet B. During the non-abutment period, a clearance is present between the movable die part 4 and metal sheet B, while no clearance is present between the metal sheet B and the portion of the die block 2 facing the movable die part 4. In this arrangement, too, the presence of an abutment period and a non-abutment period in the bottom-dead-center holding period produces the effect of ensuring shape accuracy.

Figure 8:
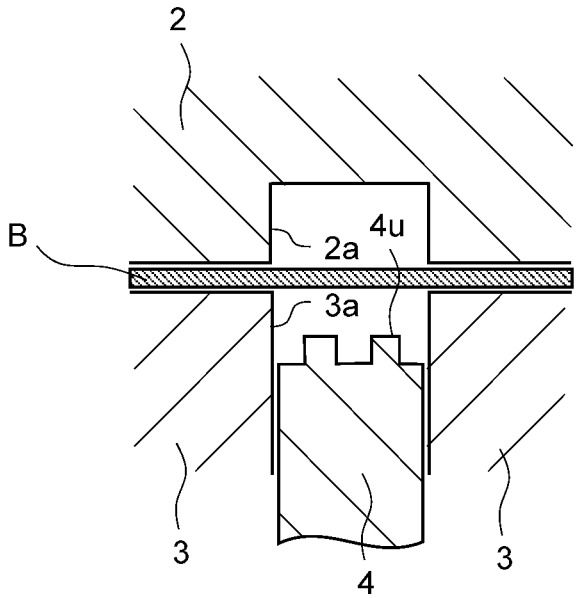
FIG. 8 shows a variation of the movable die part 4.

FIG. 8 shows a variation of the movable die part 4. In the implementation shown in FIG. 8, the top surface 4*u* of the movable die part 4 has protrusions protruding in the direction of pressing. During the abutment period of the bottom-dead-center holding period, the protrusions of the top surface 4*u* of the movable die part 4 abut the metal sheet B. The portions of the top surface 4*u* other than the protrusions, i.e., portions providing recesses, do not abut the metal sheet B. Thus, the movable die part 4 may be constructed such that, during the abutment period, some portions of the top surface 4*u* of the movable die part 4 abut the metal sheet B and the other portions do not.

In the implementation shown in FIG. 8, during the abutment period, the movable die part 4 abuts the metal sheet B and a clearance is present between the top surface 4*u* of the movable die part 4 and the metal sheet 4. For example, the proportion of the portions of the top surface 4*u* of the movable die part 4 that are in contact with the metal sheet B during the abutment period may be changed to change cooling conditions. That is, cooling conditions may be controlled by means of the shape of the movable die part 4.

Figure 9:
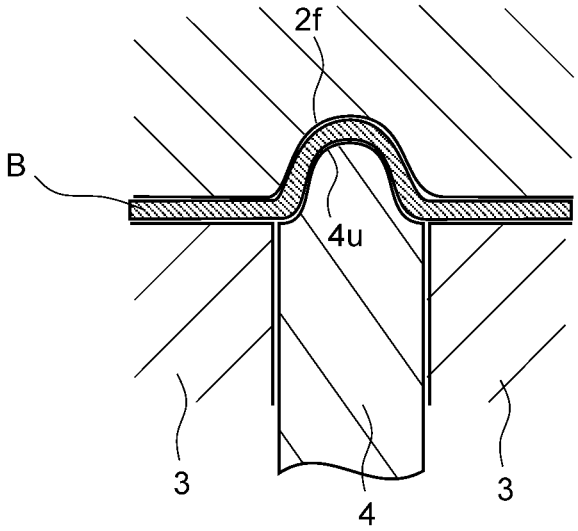
FIG. 9 shows yet another variation of the clearance portion, modified in construction.

FIG. 9 shows yet another variation of the clearance portion, modified in construction. In the implementation shown in FIG. 9, a recessed/protruding shape of the top surface 4*u* of the movable die part 4 is complementary with a recessed/protruding shape of the surface 2*f* of the die block 2 facing the top surface 4*u*. More specifically, the top surfaces are shaped such that the protrusion of the top surface 4*u* is fitted into the recess of the surface 2*f* facing it. During the abutment period of the bottom-dead-center holding period, while the movable die part 4 abuts the metal sheet B, the surface 2*f* of the die block 2 that faces the movable die part also abuts the metal sheet B. In this arrangement, the metal sheet B is formed into a shape corresponding to the shape of the top surface 4*u* of the movable die part 4. In the implementation shown in FIG. 9, the surface of the die block 2 faces the movable die part 4; alternatively, a movable die part may also be provided in the die block 2, positioned to face the movable die part 4.

Although not limiting, the hot press apparatus and the method of manufacturing the hot press-formed product according to the embodiments may be applied to, for example, manufacturing of structural members for vehicles. Structural members for vehicles are often required to be provided with a strength distribution and provide shape accuracy. The embodiments may suitably be applied to such structural members for vehicles. For example, the hot press apparatus according to an embodiment may manufacture a structural member for a vehicle constituted by a hot press-formed product (i.e., hot-stamped member) having some portions, within a single part, that have been softened in order to reduce the weight of the vehicle or achieve high performance, for example. Examples of such structural members for vehicles include high-strength center pillars having soft flanges or rear side members or bumper beams in which softened portions are positioned so as to control sharp-bend mode upon an impact.

EXAMPLES

B-pillar dies that enabled clearance control (hereinafter referred to as controllable-clearance die) were fabricated and tested. The construction of a controllable-clearance die was the same as the construction shown in FIG. 1. The controllable-clearance dies featured the presence of clearance portions at positions corresponding to the flanges of a B-pillar. A clearance portion included a recess (i.e., blank) in a die block 2 and a recess in a punch 3 facing that recess, a movable die part being positioned in the recess of the punch. The movable die part allowed the amount of clearance for the recess of that punch to be changed to 0 mm or 13 mm. The clearance portion was not cooled by the die and thus cooled gradually such that the metallic microstructure of the corresponding portion of the metal sheet was softened. For the testing, the metal sheet used was a hot-rolled sheet to be hot stamped (hereinafter HS) (thickness: 2.6 mm). The metal sheet was heated for 5 minutes in a furnace set to 900° C., transported to the controllable-clearance die, and, after a bottom-dead-center holding period of 30 seconds, removed from the die and left to cool. The four sets of clearance conditions during bottom-dead-center holding shown in Table 1 below were used.

TABLE 1

| | | |
|---|---|---|
| (a) | Clearance-less die | without clearance (0 mm) |
| (b) | Fixed-clearance die | with clearance (13 mm) |

TABLE 1-continued

| | | |
|---|---|---|
| (c) | Controllable-clearance die (early abutting) | with clearance (0 mm, and 13 mm after 15 s) |
| (d) | Controllable-clearance die (late abutting) | with clearance (13 mm, and 0 mm after 15 s) |

In Table 1, condition set (a) means that a die without a clearance was used for press forming, and represents typical HS conditions, where the entire surface of the metal sheet including the flanges contacts the die. Condition set (b) means that a die having fixed clearances at positions corresponding to the flanges was used for press forming. Clearances were provided in both the die block and punch. The amount of clearance was constant throughout the bottom-dead-center holding period. Upon completion of the bottom-dead-center holding period, the metal sheet was removed from the die while the portions corresponding to the flanges were still at high temperatures. Condition sets (c) and (d) mean that the amount of clearance for the punch was changed during bottom-dead-center holding. The thermal history of condition set (c) was the same as that of the implementation shown in FIG. 4, and the thermal history of condition set (d) was the same that of as the implementation shown in FIG. 5. Under condition set (c), the amount of clearance between the movable die part and metal sheet at the beginning of bottom-dead-center holding was 0 mm and, five seconds after the beginning of bottom-dead center holding, the amount of clearance was changed from 0 mm to 13 mm to switch to gradual cooling. Under condition set (d), the amount of clearance at the beginning of bottom-dead-center holding was 13 mm and, 25 seconds after the beginning of bottom-dead-center holding, the amount of clearance was changed from 13 mm to 0 mm to switch to die cooling. A movable die part was provided in a recess in the punch. A recess without a movable die part was provided in the surface of the die block facing the movable die part. That is, the amount of clearance for the die block was constant throughout the bottom-dead-center holding period.

Figure 10:
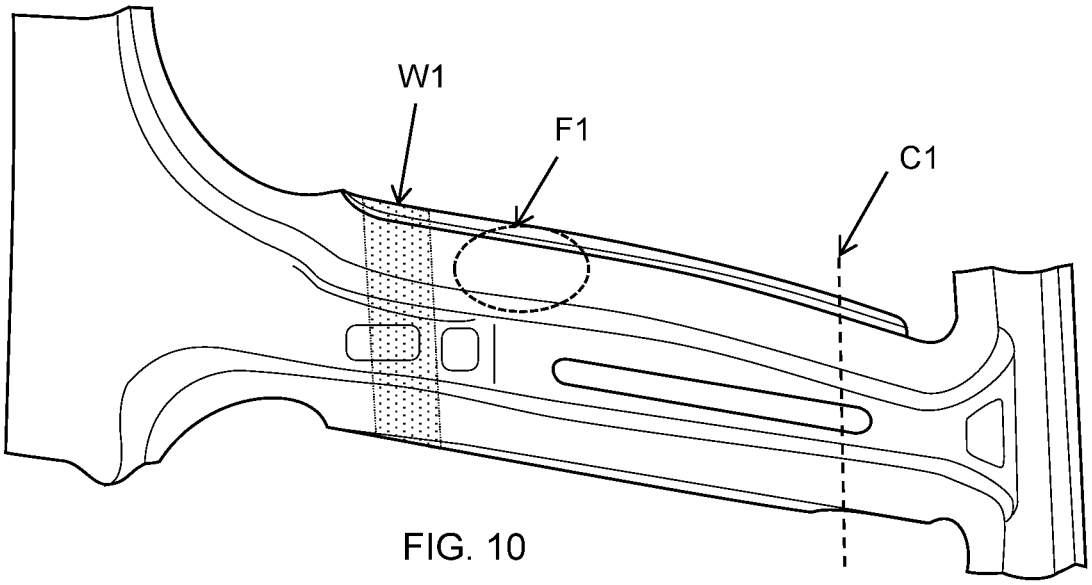
FIG. 10 shows the position on the formed product of an embodiment at which shape accuracy is evaluated.

The formed products after hot press forming were evaluated with respect to the hardness and shape accuracy of the flanges. Shape accuracy was evaluated based on the twisting of the formed product and the out-of-plane deformation of the flanges. The position on the formed product of an example at which shape accuracy was evaluated is shown in FIG. 10. The shape accuracy for each of condition sets (b), (c) and (d) was evaluated with respect to the data from condition set (a).

Figure 11:
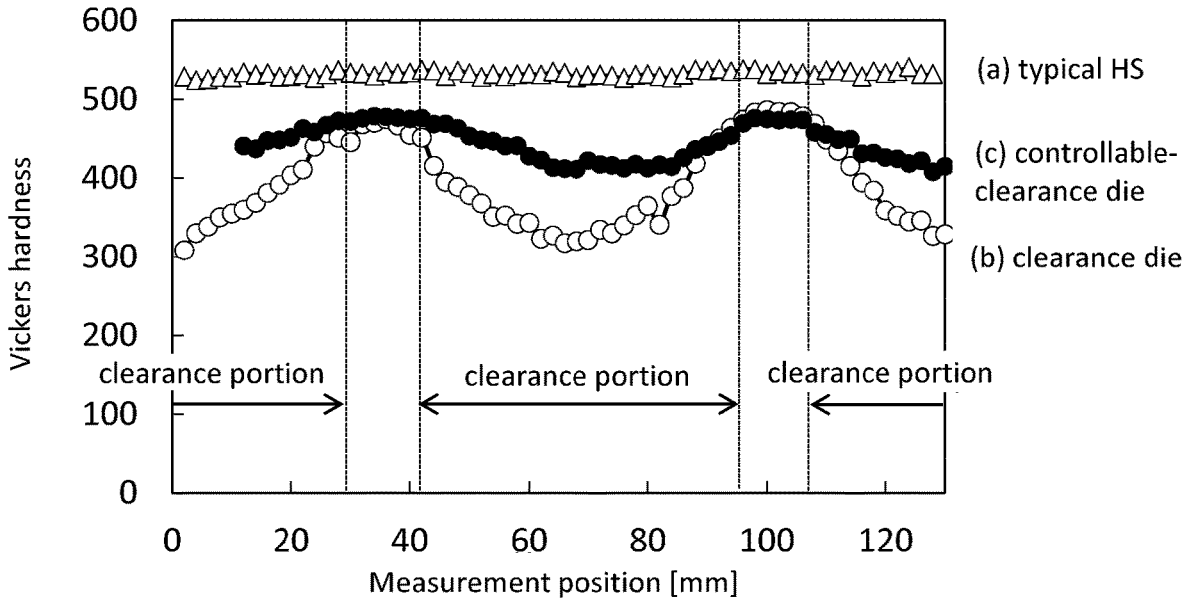
FIG. 11 is a graph showing the results of measurement of the hardness distributions of formed products.

FIG. 11 is a graph showing the results of measurement of the hardness distributions of the formed products. Compared with the formed product from condition set (a), the formed products from condition sets (b) and (c) had low hardnesses at the clearance portions. Clearance portion means the portion of the formed product corresponding to a clearance of the die. The results shown in FIG. 11 demonstrate the partial softening effect produced by the clearance portions of the fixed-clearance and controllable-clearance dies.

Figure 12:
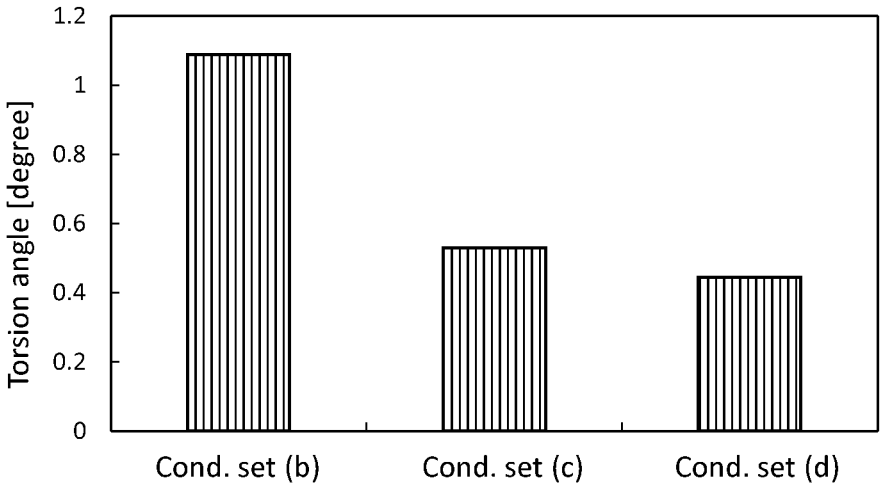
FIG. 12 is a graph showing the results of measurement of the torsion angles of formed products.

FIG. 12 is a graph showing the results of measurement of the torsion angles of the formed products. Torsion angle in the graph of FIG. 12 indicates to what degree the torsion-evaluation cross section Cl was twisted relative to that in the formed product from condition set (a), as found when the formed products from condition sets (a) to (d) were aligned in position with respect to the torsion-alignment surface W1 shown in FIG. 10.

The results shown in FIG. 12 demonstrate that the formed product formed by the fixed-clearance die of condition set (b) had larger twisting, i.e., lower shape accuracy, than that from condition set (a) without a clearance. On the other hand, the formed products press formed by the controllable-clearance dies of condition sets (c) and (d) had torsion angles not higher than a half of that from condition set (b), demonstrating improvements in shape accuracy.

Figure 13:
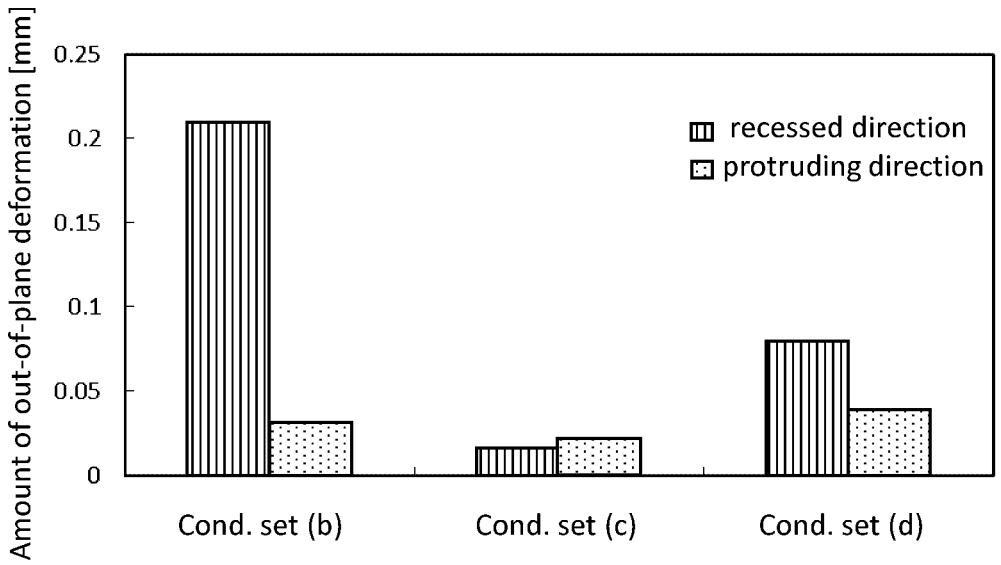
FIG. 13 is a graph showing the results of measurement of the out-of-plane deformations of formed products.

FIG. 13 is a graph showing the results of measurement of the out-of-plane deformations of the formed products. An amount of out-of-plane deformation shown in the graph of FIG. 13 indicates the amount of deformation of the surface at the out-of-plane deformation evaluation position F1 shown in FIG. 10 relative to that of the formed product from condition set (a). The out-of-plane deformation evaluation position F1 for each of condition sets (b) to (d) was a portion including a position on a flange corresponding to a clearance in the die. The examples shown in FIG. 13 demonstrate that the controllable-clearance dies from condition sets (c) and (d) also improved local shape accuracy in the flanges corresponding to the clearance portions.

Although embodiments of the present invention have been described, the above-described embodiments are merely illustrative examples useful for carrying out the present invention. Thus, the present invention is not limited to the above-described embodiments, and the above-described embodiments, when carried out, may be modified as appropriate without departing from the spirit of the invention.

EXPLANATION OF CHARACTERS

1: press apparatus
2: die block
3: punch
4: movable die part
9: control unit

The invention claimed is:

1. A hot press apparatus comprising:

a first die part;

a second die part capable of moving relative to the first die part in a direction of pressing; and a control unit adapted to control relative movement of the first die part and the second die part, wherein at least one of the first die part and the second die part includes a recess in a surface facing the other die part in the direction of pressing, a movable die part is provided in the recess, the movable die part movable in a direction crossing the surface facing the other part, and the control unit controls a position of the movable die part such that a heated and press formed metal sheet is held between the first die part and the second die part and a bottom-dead-center holding period for which the first die part and the second die part are at a bottom-dead center includes an abutment period for which the movable die part is at an abutment position where the movable die part abuts the metal sheet and a non-abutment period for which the movable die part is at a retracted position where it does not abut the metal sheet, wherein when the movable die part is at the abutment position, an abutment surface of the movable die part against the metal sheet is positioned to be flush with a portion of the surface of the first die part or the second die part to be in contact with the metal sheet that surrounds the recess provided with the movable die part, and wherein during the bottom-dead-center holding period, the movable die part is controlled to move only between the abutment position and the retracted position.

2. The hot press apparatus according to claim 1, wherein the control unit causes the movable die part to abut the metal sheet in an early stage of the bottom-dead-center holding period and then causes the movable die part to be separated from the metal sheet in a late stage of the bottom-dead-center holding period.

3. The hot press apparatus according to claim 1, wherein the control unit causes the movable die part to be separated from the metal sheet in an early stage of the bottom-dead-center holding period and then causes the movable die part to abut the metal sheet in a late stage of the bottom-dead-center holding period.

4. The hot press apparatus according to claim 1, wherein the recess includes a first recess provided in the first die part and a second recess provided in the second die part and positioned to face the first recess, and the movable die part is located in at least one of the first recess and the second recess.

5. The hot press apparatus according to claim 4, wherein the movable die part is provided in each of the first recess and the second recess.

6. The hot press apparatus according to claim 1, wherein a surface of the movable die part to be in contact with the metal sheet when the movable die part abuts the metal sheet while the die parts are at the bottom-dead center is positioned to be flush with a die surface to be in contact with the metal sheet surrounding the recess provided with the movable die part.

7. The hot press apparatus according to claim 1, wherein a top surface of the movable die part includes a protrusion adapted to abut the metal sheet and a recess adapted not to abut the metal sheet when the movable die part abuts the metal sheet while the die parts are at the bottom-dead center.

8. The hot press apparatus according to claim 1, wherein a top surface of one movable die part in one of the first die part and the second die part includes a recess or protrusion recessed or protruding in the direction of pressing; a surface of the other die part or movable die part facing the one movable die part in the direction of pressing has a shape corresponding to the recess or protrusion on the top surface of the one movable die part; and, when the one movable die part abuts the metal sheet while the die parts are at the bottom-dead center, the surface of the other die part or movable die part abuts the metal sheet facing the one movable die part.

9. The hot press apparatus according to claim 1, wherein the control unit adjusts a distance between the metal sheet and the movable die part found when the movable die part is at the retracted position.

10. The hot press apparatus according to claim 1, wherein the control unit adjusts a length of the abutment period in the bottom-dead-center holding period by controlling the position of the movable die part such that the bottom-dead-center holding period includes the abutment period and the non-abutment period.

11. A method of manufacturing a hot press-formed product, comprising:

positioning a heated metal sheet between a first die part and a second die part;

press forming the metal sheet by moving the first die part and the second die part closer to each other in a direction of pressing;

holding the metal sheet while the first die part and the second die part are at a bottom-dead center; and moving, to the metal sheet, a movable die part provided in a recess in at least one of the first die part and the second die part during a bottom-dead-center holding period for which the metal sheet is held at the bottom-dead center, wherein the bottom-dead-center holding period includes an abutment period for which the movable die part is at an abutment position where the movable die part abuts the metal sheet and a non-abutment period for which the movable die part is at a retracted position where it does not abut the metal sheet, wherein when the movable die part is at the abutment position, an abutment surface of the movable die part against the metal sheet is positioned to be flush with a portion of the surface of the first die part or the second die part to be in contact with the metal sheet that surrounds the recess provided with the movable die part, and wherein during the bottom-dead-center holding period, the movable die part is controlled to move only between the abutment position and the retracted position.

12. The method of manufacturing a hot press-formed product according to claim 11, wherein the movable die part abuts the metal sheet in an early stage of the bottom-dead-center holding period and then the movable die part is separated from the metal sheet in a late stage of the bottom-dead-center holding period.

13. The method of manufacturing a hot press-formed product according to claim 11, wherein the movable die part is separated from the metal sheet in an early stage of the bottom-dead-center holding period and then the movable die part abuts the metal sheet in a late stage of the bottom-dead-center holding period.

14. The method of manufacturing a hot press-formed product according to claim 11, wherein a surface of the movable die part to be in contact with the metal sheet when the movable die part abuts the metal sheet while the die parts are at the bottom-dead center is positioned to be flush with a die surface to be in contact with the metal sheet surrounding the recess provided with the movable die part.

15. The method of manufacturing a hot press-formed product according to claim 11, wherein a top surface of the movable die part includes a protrusion adapted to abut the metal sheet and a recess adapted not to abut the metal sheet when the movable die part abuts the metal sheet while the die parts are at the bottom-dead center.

16. The method of manufacturing a hot press-formed product according to claim 11, wherein a top surface of one movable die part in one of the first die part and the second die part includes a recess or protrusion recessed or protruding in the direction of pressing; a surface of the other die part or movable die part facing the one movable die part in the direction of pressing has a shape corresponding to the recess or protrusion on the top surface of the one movable die part; and, when the one movable die part abuts the metal sheet while the die parts are at the bottom-dead center, the surface of the other die part or movable die part facing the one movable die part abuts the metal sheet.

17. The method of manufacturing a hot press-formed product according to claim 11, wherein a cooling condition is controlled by adjusting a length of the abutment period in the bottom-dead center holding period.

* * * * *